US009076430B2

(12) United States Patent
Horrall et al.

(10) Patent No.: US 9,076,430 B2
(45) **Date of Patent: *Jul. 7, 2015**

(54) SOUND MASKING SYSTEM

(75) Inventors: Thomas R. Horrall, Harvard, MA (US); John C. Heine, Weston, MA (US)

(73) Assignee: Cambridge Sound Management, Inc., Waltham, MA (US)

( * ) Notice: Subject to any disclaimer, the term of this patent is extended or adjusted under 35 U.S.C. 154(b) by 600 days.

This patent is subject to a terminal disclaimer.

(21) Appl. No.: 11/699,538

(22) Filed: Jan. 29, 2007

(65) Prior Publication Data

US 2007/0133816 A1 Jun. 14, 2007

Related U.S. Application Data

(63) Continuation of application No. 10/420,954, filed on Apr. 22, 2003, now abandoned, which is a continuation-in-part of application No. 10/280,104, filed on Oct. 24, 2002, now Pat. No. 7,194,094.

(60) Provisional application No. 60/345,362, filed on Oct. 24, 2001.

(51) Int. Cl.
*G10K 11/175* (2006.01)
*H04R 1/02* (2006.01)
(Continued)

(52) U.S. Cl.
CPC ..... *G10K 11/175* (2013.01); *H04R 1/025* (2013.01); *H04R 3/02* (2013.01); *H04R 3/12* (2013.01); *H04R 27/00* (2013.01); *H04R 2201/021* (2013.01)

(58) Field of Classification Search
CPC ..... G10K 11/175; H04R 1/025; H04R 3/12; H04R 3/02; H04R 27/00; H04R 2201/021
USPC ..... 381/73.1, 103, 102, 105, 94.1, 160, 381/345–347, 350; 181/155, 156
See application file for complete search history.

(56) References Cited

U.S. PATENT DOCUMENTS 3,298,455 A 1/1967 Kodaras et al.
3,497,623 A 2/1970 Todd
(Continued)

FOREIGN PATENT DOCUMENTS

GB 2 188 811 A 10/1987
WO WO 99/46958 9/1999

OTHER PUBLICATIONS

Greenhill, Laurence "Speaker Cables: Can You Hear the Difference?", Stereo Review, Aug. 1983.*
(Continued)

*Primary Examiner* — Ping Lee
(74) *Attorney, Agent, or Firm* — Hamilton, Brook, Smith & Reynolds, P.C.

(57) ABSTRACT

A sound masking system according to the invention is disclosed in which one or more sound masking loudspeaker assemblies are coupled to one or more electronic sound masking signal generators. The loudspeaker assemblies in the system of the invention have a low directivity index and preferably emit an acoustic sound masking signal that has a sound masking spectrum specifically designed to provide superior sound masking in an open plan office. Each of the plurality of loudspeaker assemblies is oriented to provide the acoustic sound masking signal in a direct path into the predetermined area in which masking sound is needed. In addition, the sound masking system of the invention can include a remote control function by which a user can select from a plurality of stored sets of information for providing from a recipient loudspeaker assembly an acoustic sound masking signal having a selected sound masking spectrum.

26 Claims, 11 Drawing Sheets

(51) Int. Cl.

| | |
|---|---|
| ***H04R 3/12*** | (2006.01) |
| *H04R 3/02* | (2006.01) |
| *H04R 27/00* | (2006.01) |

(56) References Cited

U.S. PATENT DOCUMENTS

| | | | | | |
|---|---|---|---|---|---|
| 3,849,679 | A | | 11/1974 | Massa | |
| 3,879,578 | A | * | 4/1975 | Wildi | 381/73.1 |
| 3,980,827 | A | | 9/1976 | Sepmeyer et al. | |
| 3,985,200 | A | | 10/1976 | Sepmeyer | |
| 3,985,957 | A | | 10/1976 | Torn | |
| 4,010,324 | A | * | 3/1977 | Jarvis et al. | 381/73.1 |
| 4,024,535 | A | | 5/1977 | Goldstein | |
| 4,052,564 | A | | 10/1977 | Propst et al. | |
| 4,052,720 | A | | 10/1977 | McGregor et al. | |
| 4,054,751 | A | | 10/1977 | Calder et al. | |
| 4,059,726 | A | | 11/1977 | Watters et al. | |
| 4,122,315 | A | | 10/1978 | Schroeder et al. | |
| 4,185,167 | A | | 1/1980 | Cunningham et al. | |
| 4,280,019 | A | | 7/1981 | Propst et al. | |
| 4,319,088 | A | | 3/1982 | Orfield | |
| 4,390,748 | A | | 6/1983 | Zwicker | |
| 4,438,526 | A | | 3/1984 | Thomalla | |
| 4,450,321 | A | | 5/1984 | Quigley et al. | |
| 4,476,572 | A | | 10/1984 | Horrall et al. | |
| 4,622,691 | A | | 11/1986 | Tokumo et al. | |
| 4,661,982 | A | * | 4/1987 | Kitazato et al. | 381/103 |
| 4,674,124 | A | | 6/1987 | Horrall et al. | |
| 4,686,693 | A | | 8/1987 | Ritter | |
| 4,907,671 | A | | 3/1990 | Wiley | |
| 4,914,706 | A | | 4/1990 | Krause | |
| 5,167,236 | A | | 12/1992 | Junker | |
| 5,192,342 | A | | 3/1993 | Baron et al. | |
| 5,360,469 | A | | 11/1994 | Baron et al. | |
| 5,574,796 | A | * | 11/1996 | Keezer | 381/386 |
| 6,310,440 | B1 | | 10/2001 | Lansing et al. | |
| 6,359,636 | B1 | | 3/2002 | Schindler et al. | |
| 6,481,173 | B1 | | 11/2002 | Roy et al. | |
| 2001/0021259 | A1 | | 9/2001 | Horrall | |
| 2002/0150261 | A1 | | 10/2002 | Moeller et al. | |
| 2003/0048910 | A1 | * | 3/2003 | Roy et al. | 381/73.1 |

OTHER PUBLICATIONS

Engineering News, Altec Lansing, Technical Letter No. 162.
Atlas Sound Product Catalog; (2000).
Bose Catalog of the Acoustimass-3, Series III speaker system; (1999); pp. 1-3.
Dzubay, G.; "Sound Masking for Offices Unmasked"; (1997); pp. 34-46.
Sound Advance Product Sheet; FM1 FastMount Series; (2001).
Taylor, A.; Atlas Sound; "Sound Masking Systems"; (2000).
Lencore Accoustics Corp's Preliminary Invalidity and Non-Infringement Disclosures; (2009) pp. 1-40.
Amended Request for Inter Partes Reexamination, Reexam No. 95/000,499, for U.S. Patent No. 7,194,094, filed Nov. 17, 2009.
Office Action, Reexam No. 95/000,499, dated Jan. 4, 2010.
Order Granting Request for Reexamination, Reexam No. 95/000,499, dated Jan. 4, 2010.
Amendment and Response Under 37 C.F.R. § 1.111 Reexam No. 95/000,499, dated Mar. 4, 2010.
Declaration of Ashton Taylor Under 37 C.F.R. § 1.132, Reexam No. 95/000,499, dated Mar. 4, 2010.
Declaration of Edward L. Logsdon, P.E., Under 37 C.F.R. § 1.132 Reexam No. 95/000,499, dated Mar. 4, 2010.
Comments by Third Party Requester, Reexam No. 95/000,499, dated Apr. 1, 2010.
Declaration of Peter Dorchain Under 37 C.F.R. § 1.132, Reexam No. 95/000,499, dated Mar. 31, 2010.
"The HUSHER Sound Masking System Guidelines and Specifications," 6 pages, Mar. 1977.
Farrell, R., "Masking Noise Systems in Open and Closed Spaces," presented at 39$^{th}$ convention, 19 pages, Oct. 12-15, 1970.
Declaration of Thomas R. Horrall Under 37 C.F.R. § 1.132, filed Sep. 25, 2006.
Three Photographs of the HUSHER sound masking device, as late as Oct. 23, 2000.
Action Closing Prosecution, Reexam No. 95/000,499, dated Sep. 23, 2010.
Beranek, L. L., editor, "Noise and Vibration Conrol," McGraw-Hill, Inc., 1971, p. 4.
Everest, F.A., "The Master Handbook of Acoustics," TAB Books, pp. 8-10 (3$^{rd}$ ed. 1994).
Olson, H. F., "Music, Physics and Engineering," Dover Publications, Inc., New York, pp. 10-11 (2$^{nd}$ ed. 1967).
Davis, G. and Jones, R., "The Sound Reinforcement Handbook," Hal Leonard Corp., Milwaukee, Wisconsin, preface and pp. 212-215 (2$^{nd}$ ed. 1989).
Towne, D.H. "Wave Phenomena," Dover Publications, Inc., New York, pp. 281-282 (1967).
Colloms, M., "High Performance Loudspeakers," Chapter 2, Pentech Press, London pp. 9-27 (3$^{rd}$ ed. 1985).
Moir, J., "Speaker directivity and sound quality," Wireless World, pp. 61-63 and 98 (Oct. 1979).
Henricksen, C., "Directivity Response of Single Direct-Radiator Loudspeakers in Enclosures," Altec Lansing Corp., Technical Letter No. 237, pp. 1-6 (1986).
Weems, D.B., and Koonce, G.R., "Great Sound Stereo Speaker Manual," Chapter 2, Second Edition, McGraw-Hill, New York, pp. 14-17 (2000).
Third Party Requester's Amended Appeal Brief, Reexam No. 95/000,499, filed Jul. 21, 2011.
Patent Owner's Respondent Brief, Reexam No. 95/000,499, filed May 23, 2011.
Examiner's Answer, Reexam No. 95/000,499, dated Nov. 18, 2011.
Third Party Requester's Rebuttal Brief, Reexam No. 95/000,499, dated Dec. 19, 2011.
Decision on Appeal, Reexam No. 95/000,499, dated Aug. 24, 2012.
Third Party Requester's Request for Rehearing, Reexam No. 95/000,499, dated Sep. 24, 2012.
Atlas Sound, White Paper, "Speaker Diameter vs. Speaker Directivity" 1 page (2002).
Patent Owner's Comments in Opposition to Third Party Requester's Request for Rehearing, Reexam No. 95/000,499, dated Oct. 24, 2012.
Decision on Request for Rehearing, dated Mar. 22, 2013.
DSP Sound Masking Generator/Equalizers, MG2001, MG3001; Northeast Total Communications as late as Oct. 23, 2000.

* cited by examiner

SOUND MASKING SYSTEM

CROSS REFERENCE TO RELATED APPLICATIONS

This present application is a continuation under U.S.C. §120 of U.S. application Ser. No. 10/420,954 filed on Apr. 22, 2003 now abandoned, which was a continuation-in-part application under U.S.C. §120 of U.S. application Ser. No. 10/280,104, filed on Oct. 24, 2002 now U.S. Pat. No. 7,194,094, and further claims priority under 35 U.S.C. §119(e) of U.S. Provisional application No. 60/345,362, filed on Oct. 24, 2001, all of which were entitled SOUND MASKING SYSTEM, the whole of which are hereby incorporated by reference herein.

STATEMENT REGARDING FEDERALLY SPONSORED RESEARCH OR DEVELOPMENT

N/A

BACKGROUND OF THE INVENTION

This invention relates to sound masking systems and, in particular, to sound masking systems for open plan offices.

Freedom from distraction is an important consideration for workers' satisfaction with their office environment. In a conventional enclosed office with full height partitions and doors, any speech sound intruding from outside the office is attenuated or inhibited by the noise reduction (NR) qualities of the wall and ceiling construction. Background noise, such as from the building heating or ventilating (HVAC) system, typically masks or covers up residual speech sound actually entering the office. Under normal circumstances, even very low levels of background nose reduce audibility of the residual speech to a sufficiently low level that the office worker is unable to understand more than an occasional word or sentence from outside and is, therefore, not distracted by the presence of colleagues' speech. In fact, it was shown more than 35 years ago that a standardized objective measure of speech intelligibility called the Articulation Index, or AI, reliably predicts most peoples' satisfaction with their freedom from distraction in the office. "Perfect" intelligibility corresponds to an AI of 1.0, while "perfect" privacy corresponds to an AI of 0.0. Generally, office workers are satisfied with their privacy conditions if the AI of intruding speech is 0.20 or less, a range referred to as "normal privacy" or better.

In recent years, the "open plan" type of office design has become increasingly popular. The open plan design includes partial height partitions and open doorways between adjacent workstations. Due to its obvious flexibility in layout and its advantages in enhancing communication between co-workers, the open plan office design is increasingly popular. However, despite the advantages of the open plan type office, unwanted speech from a talker in a nearby workstation is readily transmitted to unintended listeners in nearby workstation areas.

To reduce the level of unwanted speech in open plan offices, some limited acoustical measures can be employed. For example, highly sound absorptive ceilings reflect less speech, higher partitions attenuate direct path sound signals, particularly for seated workers, and higher partitions also diffract less sound energy over their tops. Additionally, the open doorways can be placed so that no direct path exists for sound transmission directly from workstation to workstation, and the interiors of workstations can be treated with sound absorptive panels. Nevertheless, even in an acoustically well designed open office, the sound level of intruding speech is substantially greater than in an enclosed office space. One other important method that can be used to obtain the normal privacy goal of 0.20 AI in an open plan office is to raise the level of background sound, usually by an electronic sound masking system.

Conventional sound masking systems typically comprise four main components: an electronic random noise generator, an equalizer or spectrum shaper, a power amplifier, and a network of loudspeakers distributed above the office, usually in the ceiling plenum. The equalizer adjusts the white noise spectrum provided by the electronic random noise generator to compensate for the frequency dependent acoustical filtering characteristics of the ceiling and plenum and to obtain the sound masking spectrum shape desired by the designer. The power amplifier raises the signal voltage to permit distribution to the loudspeakers without unacceptable loss in the network lines and ceiling tiles. The generator, equalizer, and power amplifier may be integrated with a speaker or may be located at a central location connected to the loudspeaker distribution network.

The goal of any sound masking system is to mask the intruding speech with a bland, characterless but continuous type of sound that does not call attention to itself. The ideal masking sound fades into the background, transmitting no obvious information. The quality of the masking sound of all currently sold devices is subjectively similar to that of natural random air turbulence noise generated by air movement in a well-designed heating and ventilating system. By contrast, if it has any readily identifiable or unnatural characteristics such as "rumble," "hiss," or tones, or if it exhibits obvious temporal variations of any type, it readily becomes a source of annoyance itself.

Obtaining the correct level or volume of the masking sound also is critical. The volume of sound needed may be relatively low intensity if the intervening office construction, such as airtight full height walls, provides a high NR. However, the volume of the masking sound must be a relatively high intensity if the construction NR is reduced by partial-height intervening partitions, an acoustically poor design or layout, or materials that have a high acoustic reflectivity. Even in an acoustically well designed open office, the level of masking noise necessary to meet privacy goals may be judged uncomfortable by some individuals, especially those with certain hearing impairments. However, if the masking sound has a sufficiently neutral, unobtrusive spectrum of the right shape, the intensity of the masking sound can be raised to a sound level or volume nearly equal to that of the intruding speech itself, effectively masking it, without becoming objectionable.

Subjective spatial quality is another important attribute of sound masking systems. The masking sound, like most other natural sources of random noise, must be subjectively diffuse in quality in order to be judged unobtrusive. Naturally generated air noise from an HVAC system typically is radiated by many spatially separated turbulent eddies generated at the system terminal devices or diffusers. This spatial distribution of sources imparts a desirable diffuse and natural quality to the sound. In contrast, even if a masking system provides an ideal spectrum shape and sound level, its quality will be unpleasantly "canned" or colored subjectively if it is radiated from a single loudspeaker or location. A multiplicity of spatially separated loudspeakers radiating the sound in a reverberant (sound reflective) plenum normally is typically used in order to provide this diffuse quality of sound. Almost all plenums use non-reflective ceiling materials and fireproofing materials and require two or more channels radiating different (incoherent) sound from adjacent loudspeakers in order to obtain the required degree of diffusivity. Each loudspeaker normally serves a masking zone of about 100-200 square feet each (i.e. placed on 10' to 14' centers). In most cases, the plenum space above the ceiling is an air-return plenum so that the loudspeaker network cable must be enclosed in metal conduit or use special plenum-rated cable in order to meet fire code requirements.

A typical system diffuses the acoustic sound masking signal by placing the loudspeakers in the plenum space facing upward to reflect the acoustic masking signal off the hard deck. As a result, direct path energy from the location of a loudspeaker to the ear of the listener is intentionally minimized by the acoustic sound masking signal that propagates substantially throughout the above ceiling volume and filters down through the ceiling and ceiling elements such as light fixtures, mechanical system grilles, return air openings, etc., at locations somewhat removed from the loudspeaker location. The effectiveness of this approach to diffusion depends on several characteristics. These include the directivity characteristics of the loudspeakers, elements in the plenum such as mechanical system ducts, and on the physical characteristics of the ceiling material itself, such as its density and upper surface acoustical absorption. Costly measures are sometimes needed to improve the uniformity and diffuseness of the masking sound. Some of these measures include employing special vertically directional baffles for the loudspeakers to spread the sound horizontally and coating the upper surface of the ceiling tile with special foils to further spread out the masking sound horizontally. In high density ceilings with large openings for HVAC return air, specially designed acoustical grill "boots" are often necessary to avoid excessive concentration of masking sound, or "hot spots."

In addition, the sound attenuation characteristics of the ceiling assembly are normally not knowable until after installation and testing. Since masking system loudspeakers are normally installed before the ceiling for reasons of access and economy costly adjustable frequency equalization for the masking sound must be provided to compensate for these site-specific characteristics. Thus, additional time and cost are incurred due to the testing and frequency adjustment that must be performed post installation.

Also, because the acoustic sound masking signal must pass through the acoustical ceiling and be attenuated thereby, a large part of the acoustical power radiated by the loudspeakers is wasted in the form of heat as the acoustic masking signal is attenuated. Accordingly, despite the requirement for only very small amounts of acoustical sound masking power within the listening space itself, relatively high power electrical signals driving large and costly loudspeakers are needed to provide the necessary masking signal strength. Due to the power required, the loudspeaker assemblies are normally large and heavy. Thus, in addition to the costs incurred by the larger amount of power required, the loudspeaker and its enclosure must be supported from additional structure rather than directly by the ceiling tile in order to avoid sagging of the lightweight ceiling material. This additional support structure increases the installation cost, and the placement of the large loudspeakers in the plenum area inhibits access to the above ceiling space, which also complicates the design and installation of the loudspeakers.

Masking loudspeakers sometimes have been installed below higher ceilings, or within the ceiling, in order to overcome some of these limitations. However, their use has been restricted to installation in facilities with atypically high ceiling heights due to appearance, masking sound uniformity, an overly small or crowded plenum area, and cost considerations. When a conventional loudspeaker is attempted below a ceiling in a more typical office environment with ceiling heights of 9'-12', or within the ceiling, the uniformity of masking sound is found to be unacceptable. In particular, conventional loudspeakers exhibit a narrow beamwidth at higher frequencies, causing "hot-spotting" on their axes. Unlike music or other time varying signals, masking sound has essentially constant bandwidth temporally, and any significant narrowing of beamwidth within the acoustic band is immediately obvious and unpleasant to most individuals. Moreover, unless loudspeakers are mounted within several feet of one another, overall level uniformity is unacceptable due to square law or distance spreading, that is, the sound level attenuates unacceptably with distance from the loudspeaker, drawing attention to its location. This close loudspeaker proximity is unsightly and uneconomic. Thus, in these systems an unacceptable number of these conventional loudspeakers are required to avoid hot-spotting and signal non-uniformity within a masking zone.

Sound masking spectra normally used in open plan offices are well documented. For example, see L. L. Beranek, "Sound and Vibration Control", McGraw-Hill, 1971, page 593. These spectra were empirically derived over a period of a number of years and are characterized by relatively high levels of sound at lower speech frequencies and by relatively low levels of sound at the higher speech frequencies. Such spectra have been found to provide both effective masking of speech sound intruding into an office and unobtrusive quality of masking sound when used in a typical office with sufficiently high partial height office partitions that act as acoustical barriers between work stations, particularly at high frequencies. These spectra have also been found to work adequately in some other office settings with sufficient high frequency inter-office speech attenuation.

The masking sound level considered unobtrusive by most open office occupants is approximately 48 dBA sound pressure level. As masking levels are increased above 48 dBA, complaints of excessive masking sound increase. Unfortunately, it can be shown that this level of sound with the typically used spectrum is largely ineffective for sound masking in an office setting without significant acoustical barriers to reduce high frequencies of intruding speech sound. If barriers are low or absent, the required distance between workstations to obtain normal speech privacy conditions may exceed 20 feet or more, even with a high quality sound masking system using a typical sound masking spectrum.

Therefore, it would be advantageous to provide a sound masking system that is easier to install, requires fewer adjustments, requires fewer components than the conventional sound masking systems, and provides more privacy in an open plan office.

BRIEF SUMMARY OF THE INVENTION

A sound masking system according to the invention is disclosed in which one or more sound masking loudspeaker assemblies are coupled to one or more electronic sound masking signal generators. The loudspeaker assemblies in the system of the invention have a low directivity index and preferably emit an acoustic sound masking signal that has a sound masking spectrum specifically designed to provide superior sound masking in an open plan office. Each of the plurality of loudspeaker assemblies is oriented to provide the acoustic sound masking signal in a direct path into the predetermined area in which masking sound is needed. In addition, the sound masking system of the invention can include a remote control function by which a user can select from a plurality of stored sets of information for providing from a recipient loudspeaker assembly an acoustic sound masking signal having a selected sound masking spectrum.

In one embodiment, a direct field sound making system provides a direct path sound masking signal into a predetermined area of a building. The direct field sound masking system includes a sound masking signal generator that provides two or more electrical sound masking signals that are mutually incoherent, and a plurality of loudspeaker assemblies coupled to the sound masking signal generator. Each loudspeaker assembly receives the electrical sound masking signal from the sound masking signal generator and produces the desired acoustic sound masking signal corresponding to the received sound masking signal as modified by the acoustic transfer function of the loudspeaker. Each of the loudspeaker assemblies has a low directivity index and is oriented to provide the acoustic sound masking signal in a direct path into the predetermined area.

The acoustic sound masking signal can have a predefined spectrum that is defined in terms of intensity at certain frequencies and in certain frequency bands. In one embodiment, the acoustic spectrum has a roll off in intensity of in the range of 2-4 dB between 800-1600 Hz, between 3-6 dB between 1600-3200 Hz, and between 4-7 Hz between 3200-6000 Hz.

In another embodiment, a sound making system for providing a sound masking signal to a predetermined area of a building is disclosed that includes a sound masking signal generator. The sound masking signal generator provides two or more sound masking signal channels of mutually incoherent electrical sound masking signals corresponding to a selected one of a plurality of stored sound masking spectra. A plurality of loudspeaker assemblies are coupled to the sound masking signal generator and receive the electrical sound masking signal therefrom. Each of the plurality of loudspeaker assemblies emits an acoustic sound masking signal corresponding to the electrical sound masking signal as modified by the acoustic transfer function of the loudspeaker. The acoustic sound masking signal has a sound masking spectrum that corresponds to the selected spectrum. A remote control unit is provided and is remotely linked to the masking signal generator via an infrared, radio frequency, ultrasonic, or other signal and provides commands and data to the masking signal generator. In one embodiment, the remote control can be used to select one of a plurality of predetermined sound masking spectra that was stored as sets of information within the masking signal generator for providing from a recipient loudspeaker assembly an acoustic sound masking signal having the selected sound masking spectrum that are stored in the sound masking signal generator. One of the stored plurality of sets of information is selected and used to provide the one or more electrical sound masking signals. The data and commands can be used to adjust a frequency component of the selected sound masking spectrum, select another of the plurality of stored spectra, or provide other functions such as power on/off.

In another aspect, the invention is directed to a bolt and nut threading system for positioning and locking a nut on a bolt. The exterior surface of the bolt and the interior surface of the nut contain axially oriented, reciprocal regions with and without threads. In operation, the regions of the nut without threads are oriented to correspond to the regions of the bolt with threads. The nut is then slid along the bolt until the desired placement position is reached and locked in place with a half turn of the nut or less. Preferably, the exterior surface of the bolt and the interior surface of the nut contain two regions of equal surface area with threads alternating with two regions of equal surface area without threads. With this configuration, a quarter turn of the nut locks the nut in place.

Other features, aspects, and advantages of the above-described method and system will be apparent from the detailed description of the invention that follows.

BRIEF DESCRIPTION OF THE SEVERAL VIEWS OF THE DRAWING

The invention will be more fully understood by reference to the following Detailed Description of the Invention in conjunction with the accompanying Drawings of which.

DETAILED DESCRIPTION OF THE INVENTION

In a sound masking system according to the invention, one or more sound masking loudspeaker assemblies are coupled to one or more electronic sound masking signal generators. The loudspeaker assemblies in the system of the invention have a low directivity index and, preferably, emit an acoustic sound masking signal that has a sound masking spectrum specifically designed to provide superior sound masking in an open plan office. Each of the plurality of loudspeaker assemblies is oriented to provide the acoustic sound masking signal in a direct path into the predetermined area in which masking sound is needed. In addition, the sound masking system of the invention can include a remote control function by which a user can select one of a plurality of stored sets of information for providing from a recipient loudspeaker assembly an acoustic sound masking signal having a selected sound masking spectrum stored in the sound masking signal generator.

One of the stored plurality of sets of information is selected and used to provide the one or more electrical sound masking signals. The remote control unit can further be used to control the intensity of at least one frequency component of the selected sound masking spectrum by selecting another one of the stored sets of information. The system of the invention will be more fully explained in the following description of the typical office environment in which the system of the invention can be employed.

Figure 1A:
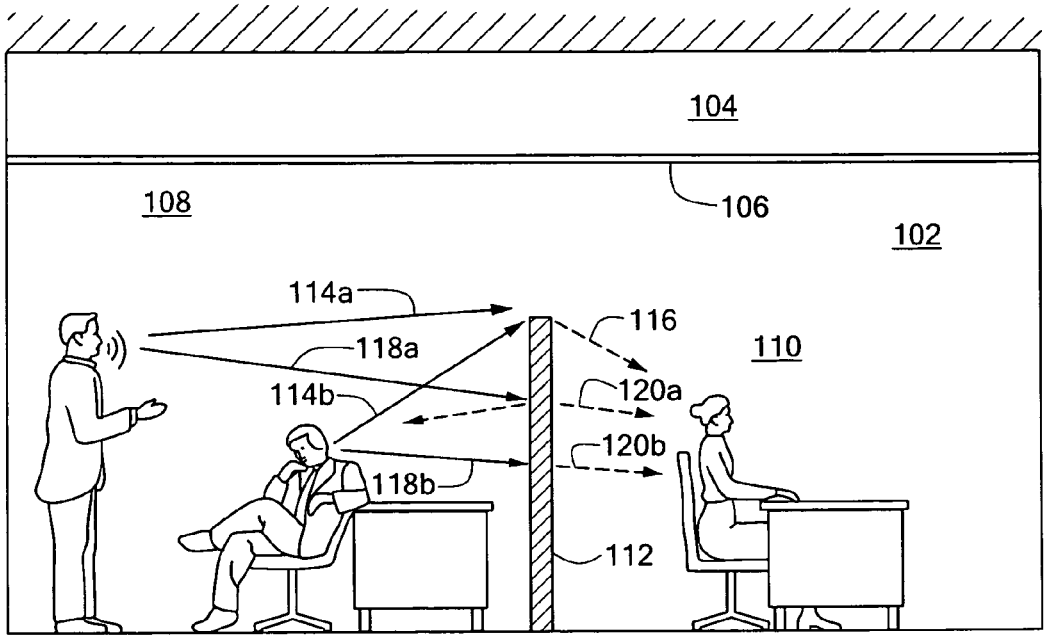
FIG. 1*a* is a plan view of an office space incorporating effective acoustic barriers between adjacent workstation spaces.

FIG. 1*a* depicts an open plan office 102 that includes first and second office spaces 108 and 110 having a ceiling 106 and a plenum 104. A divider 112, which is placed between the first and second office spaces 108 and 110, extends from the floor to a height that is sufficient to block direct path speech from the adjacent office space, regardless of whether a talker is sitting or standing. As used herein, a talker is a person speaking and a listener is a person, whether intended or not, who is capable of hearing the speech of the talker. Some speech from a talker in office space 108 will leak into the adjacent office space 110. For example, if the divider partition does not extend to the ceiling 106, a speech path 114*a* and 114*b* from a standing or sitting talker, respectively, is diffracted over the top of the divider 112, resulting in a diffracted speech path 116 entering the office space 110 from office space 108. Additionally, the noise reduction ("NR") rating of the divider may be less than 100% so that some of the speech 118*a* and 118*b* will be attenuated but still passed as sound 120*a* and 120*b* into the office space 110 from the adjacent office space 108. Furthermore, speech reflected from the ceiling and modified by the reflective characteristics of the ceiling is received by a listener in the adjacent office space. The combined effect of the divider characteristic and the resulting allowable acoustic paths is to significantly reduce the high frequency content of the speech spectrum received by the listener relative to the low frequency content.

Figure 1B:
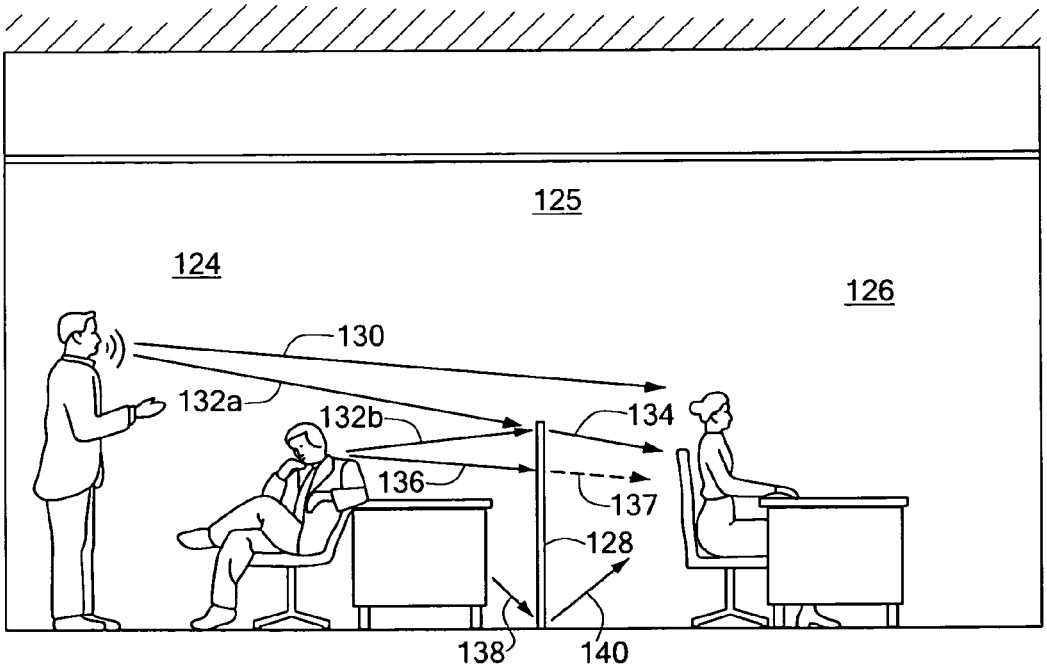
FIG. 1*b* is a plan view of an office space incorporating short acoustic barriers between adjacent workstation areas.

FIG. 1*b* depicts an office space 125 that is designed using an open plan office system. In particular, the office space 125 includes a first office space 124 and a second office space 126, which are divided by a divider 128, which is much shorter than the divider 112 in FIG. 1*a*. The shorter divider 128 does not block a direct speech path 130 between a standing talker in office space 124 and a listener in office space 126. Furthermore, ceiling reflected speech is also received by a listener in the adjacent office space, as above. In addition, the top of divider 128 can diffract a speech path 132*a* and 132*b* from a standing talker or a seated talker, respectively. Whether the talker is standing or seated, diffracted speech path 134 leaks into the adjacent office space. In addition, speech 136 from seated workers in office space 124 may be attenuated but still able to leak into the office space 126 through the divider as attenuated speech 137. Furthermore, the divider 128 may not extend completely to the floor so that, additionally, a reflected speech path 138 leaks into the adjacent office as speech path 140. Because of the reduced impact of divider 128 of FIG. 1*b*, compared to divider 112 of FIG. 1*a*, in blocking and diffracting transmitted speech, the combined effect of the received acoustic paths is to provide much less reduction of the high frequency component of the speech spectrum received by a listener in office space 126, relative to the low frequency content than is provided to a listener in office space 110 in FIG. 1*a*.

Figure 1C:
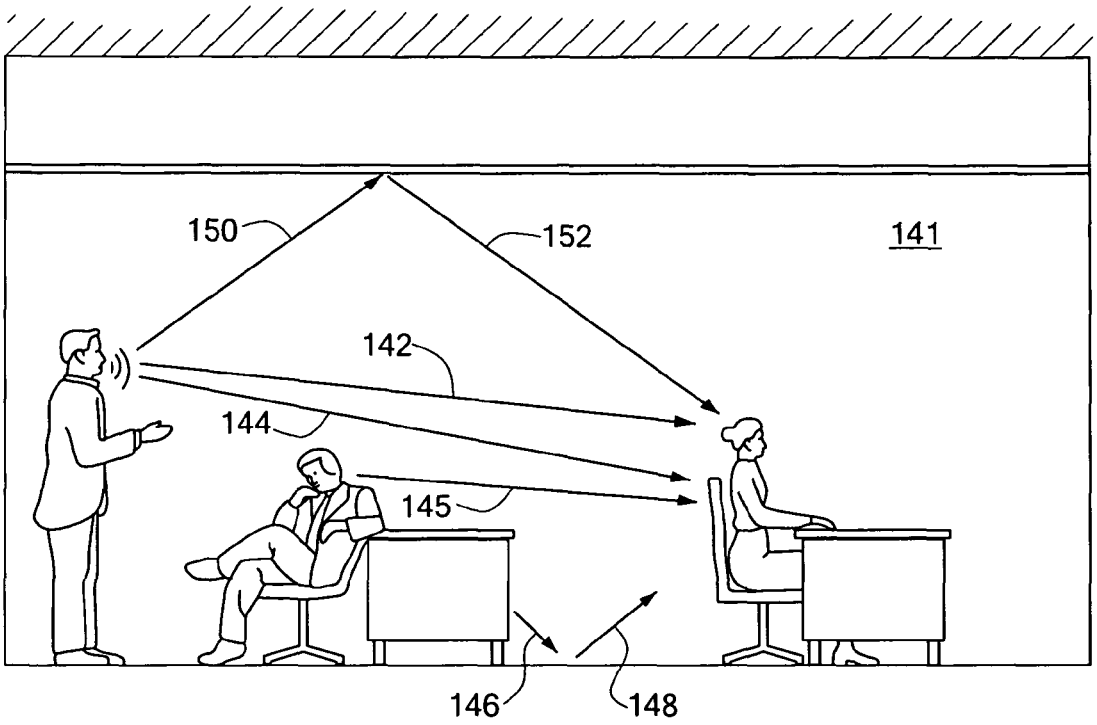
FIG. 1*c* is a plan view of an open office space, i.e., an office incorporating no acoustic barriers between adjacent workstation areas.

FIG. 1*c* depicts a completely open office area 141 with no acoustic barriers between workers. Office area 141 could also be considered as a reception area in a pharmacy or doctor's office in which privacy of people at a reception desk is at issue. In office area 141 there are no individual office spaces, and direct speech paths 142, 144, and 145 exist between individuals. In addition, reflected speech paths 146-148 and 150-152 exist between the individuals as well. In this configuration, the reflected speech paths have little impact and the high frequency content of the received speech spectrum is not reduced at all relative to the low frequency content.

As used herein, the following terms have associated therewith the following definitions. A "direct field sound masking system" is one in which the acoustic sound masking signal or signals, propagating in a direct audio path from one or more emitters, dominate over reflected and/or diffracted acoustic sound masking signals in a particular area referred to as a masking zone. A "direct audio path" is a path in which the acoustic masking signals are not reflected or diffracted by objects or surfaces and are not transmitted through acoustically absorbent surfaces within a masking area or zone. A "reverberant field sound masking system" is one in which the acoustic sound masking signal or signals, propagating in a reflected path from one or more emitters, dominate over direct audio path acoustic sound masking signals in a particular area referred to as a masking zone. A "transition region" is a region in which one or more reflected acoustic sound masking signals from one or more emitters begin to dominate over one or more direct path acoustic sound masking signals from one or more emitters within a region. The location of the transition region relative to one or more emitters is a function of the intensity and directivity of the emitted sound and the emitter, respectively, and of the characteristics of the surface and materials that comprise the reflecting surfaces.

As discussed above, an open plan office often has a sound masking system to compensate for the increased level of sounds that leak between adjacent workstation areas. The sound masking system typically includes a masking signal generator that typically provides two or more mutually incoherent signal channels of sound masking signals to one or more emitters, which typically are loudspeaker assemblies, that emit an acoustic sound masking signal that has a predetermined sound masking spectrum. These emitters are configured and oriented so as to provide a sound masking field that passes through the ceiling tiles, or a reverberant sound masking field such that the acoustic sound masking signals that comprise the sound masking field have as uniform an intensity as possible and as diffuse a field as possible.

Figure 2:
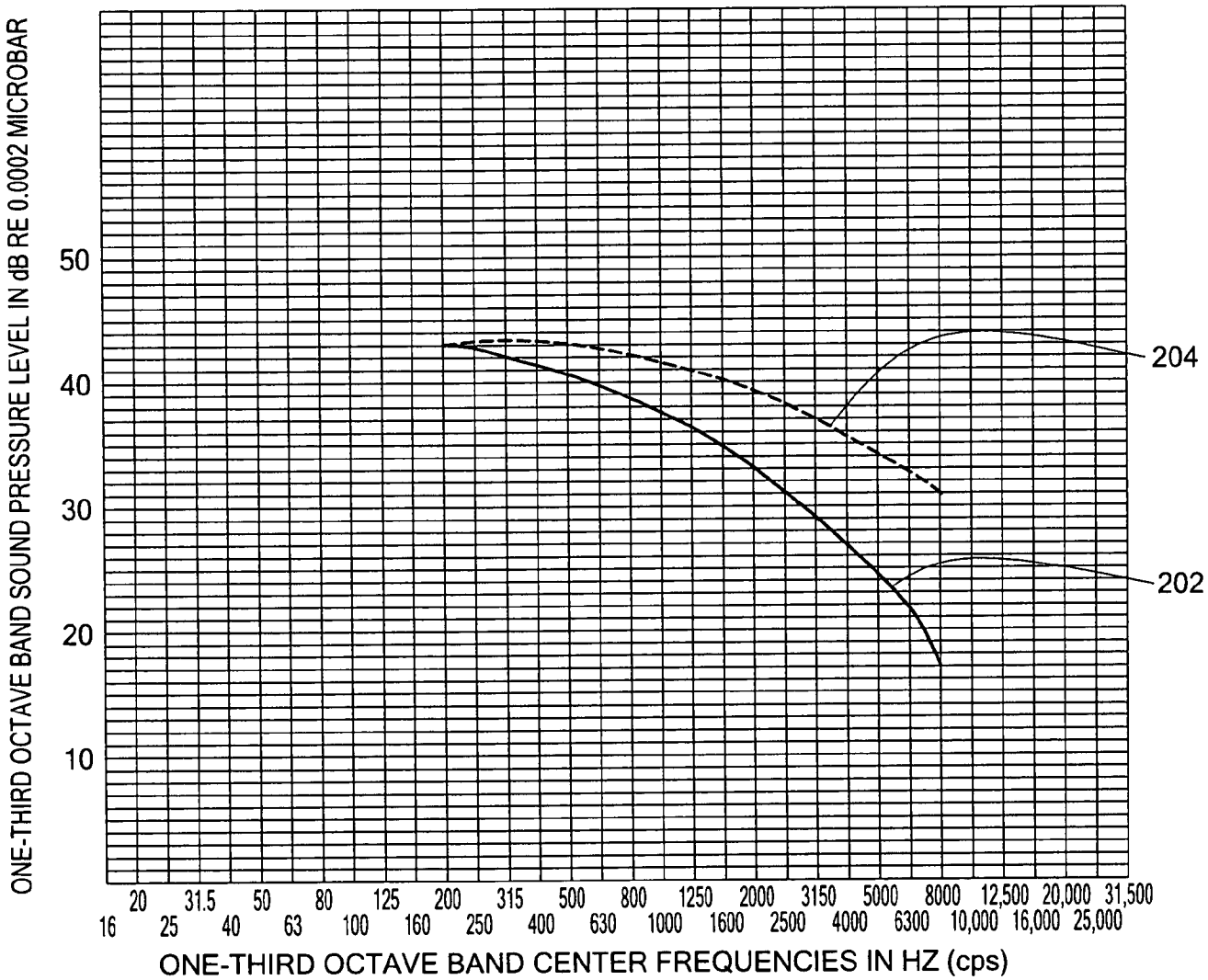
FIG. 2 is a chart depicting a typical prior art sound masking spectrum and a sound masking spectrum that is compatible with the present invention.

FIG. 2 depicts a typical prior art sound masking spectrum, curve 202, which was empirically derived for open offices with high barriers of the form depicted in FIG. 1*a*. This spectrum is described in L. L. Beranek, "Sound and Vibration Control," McGraw-Hill, 1971, page 593. It is known in the art that masking in the frequency range between 800 Hz and 5000 Hz is particularly important to reducing the Articulation Index (AI), i.e., although sound masking spectra typically extend beyond these lower and upper frequencies, the spectral characteristics within this band are particularly important. However, as office configurations are provided with lower or no barriers between individual workers, the high frequency component of the speech received by a listener in an adjacent work space increases, the AI increases and speech privacy is significantly reduced.

Therefore, sound masking systems according to the invention most preferably use a spectrum of the shape of spectrum 204 as depicted in FIG. 2. Spectrum 204 includes a larger high frequency component than spectrum 202; i.e., spectrum 204 has less "roll off" in sound intensity at higher frequencies than does spectrum 202.

The spectrum 204 is defined by the roll off in sound intensity within the approximately two and two-thirds octaves within the 800-5000 Hz band. In particular, for the 800-1600 Hz octave, the roll off in attenuation can be between 2-4 dB.

For the 1600-3200 Hz octave, the roll off in attenuation can be between 3-6 dB. For the 3200-5000 Hz partial octave, the roll off in attenuation can be between 3-5 dB. Below the 800 Hz frequency, between 200-500 Hz, the spectrum can have a roll off of between 0-2 dB, and between 500-800 Hz, there is approximately a 1-4 dB decline in intensity. Above 5000 Hz, there can be approximately a 3-7 dB roll off between 5000-8000 Hz. Thus, the sound masking spectrum 204 depicted in FIG. 2 provides a masking signal having greater sound intensity in high frequency components, i.e. frequency components above 1250 Hz, than the prior art sound masking spectrum 202. Advantageously, this provides for superior sound masking in an open plan office. Furthermore, use of the spectrum described above in a system according to the invention allows for a similar level of sound masking as in a full open plan office configuration as is obtained with the prior art spectrum in a high barrier office configuration while using less overall sound intensity.

It should be appreciated that the intensity of the lowest frequency of the sound masking spectrum described as curve 204 can be arbitrarily set without affecting the shape of the curve. The chosen intensity of the lowest frequency of the sound masking spectrum is a matter of design choice and is selected based on the acoustic characteristics of the area to be masked and the level of ambient background noise.

In some circumstances in the embodiments described herein, it may be advantageous to provide a method of adjusting the sound masking spectrum in order to properly tailor the sound masking spectrum to the particular area to be masked. Often, the masking signal generator is not easily accessible physically after installation, making any post-installation adjustments directly to the masking signal generator difficult and/or time consuming and costly. The sound masking system according to the invention preferably is provided with a remote control unit that uses, e.g., infrared, radio frequency, ultrasonic, or other signals to transmit data and commands to a complementary receiver coupled to the masking signal generator. The remote control unit can be used to select one of a plurality of predetermined sound masking spectra that are stored as sets of information in the masking signal generator for providing from a recipient loudspeaker assembly an acoustic sound masking signal having the selected spectrum. This allows a user to select the sound masking spectrum that provides the best AI performance for a specified office design for the space of interest. Alternatively, the remote control unit can act as a remote frequency equalizer and can be used to instruct the masking signal generator to individually adjust the resultant intensity of one or more frequency bands of the currently implemented sound masking spectrum to provide for example, an improved subjective sound masking quality without significantly affecting the achieved AI. Other uses of the remote control unit could include a power on/off function, a volume control function, a signal channel select function, or a sound masking zone select function.

Figure 8:
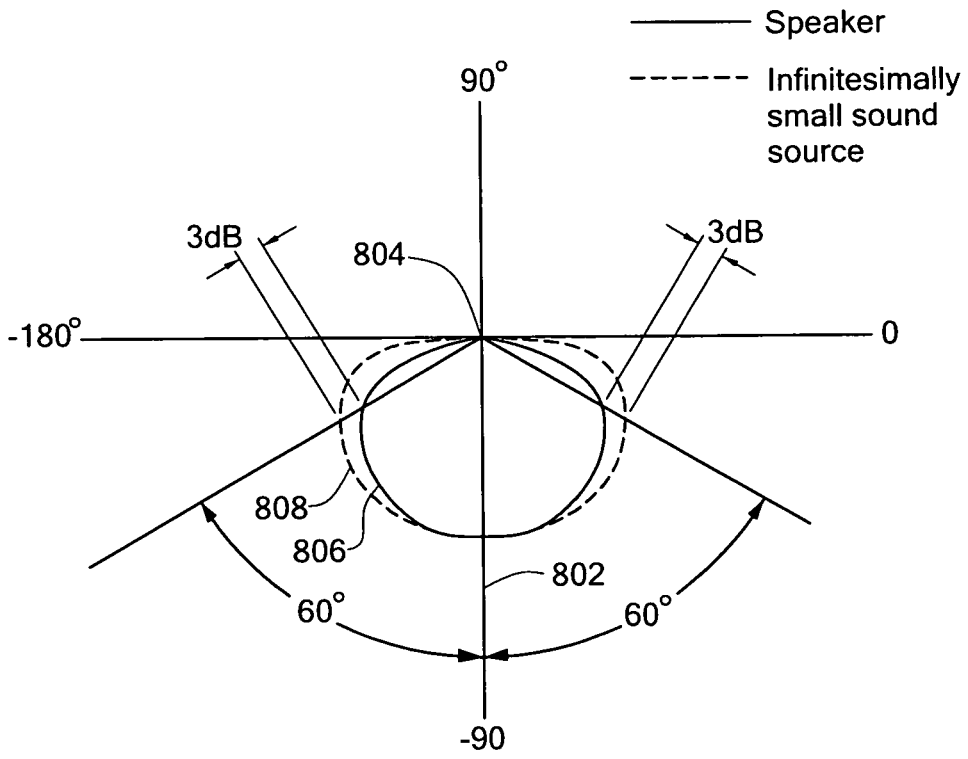
FIG. 8 is a polar plot of the output sound intensity from a loudspeaker system according to the invention compared to the output sound intensity of an infinitesimally small sound source in an infinite baffle.

In the embodiments described herein, the loudspeaker assemblies include at least one loudspeaker that has a low directivity index. Referring to FIG. 8, a loudspeaker with a low directivity index is one that, with reference to the axial direction 802 of the speaker, at location 804 provides an output sound intensity 806 at an angle of 20°, preferably 45°, and most preferably 60° from the axial direction, that is not more than 3 dB, and not less than 1 dB, lower than the output sound intensity 808 at the same angle from an infinitesimally small sound source at the same location in an infinite baffle at frequencies less than 6000 Hz, as measured in any ⅓ octave band. Accordingly, the loudspeakers used herein provide a substantially uniform acoustic output that extends nearly 180 degrees, i.e., +/−90 degrees from the axial direction of the loudspeaker assembly.

Figure 3A:
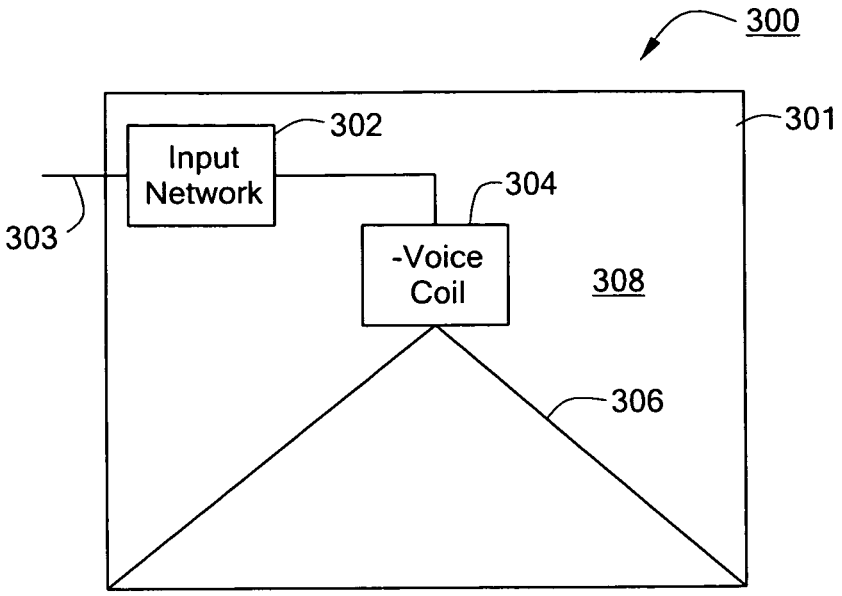
FIG. 3*a* is a schematic view of a speaker with a low directivity index that is compatible with the present invention.

FIG. 3*a* depicts a loudspeaker assembly having a low directivity index that is compatible with the embodiments described herein. In particular, the loudspeaker assembly 300 includes a substantially airtight case 308 and an input connection 303 for two or more channels of sound masking signal to the input network 302. The airtight case 308 is operative to prevent acoustic energy from entering the plenum and energizing the air within the plenum. For each loudspeaker assembly, one of the channels of sound masking signal is coupled to a voice coil 304, through the input network 302, and then to audio emitter 306. The channels of supplied sound masking signal, as determined by the input cable wire pairs, are systematically swapped by the input network to correspond to a different set of output wire pairs, insuring that adjacent loudspeakers do not radiate signals from the same channel of sound masking. In a preferred embodiment, the masking signal generator includes a low pass filter network that has a sharp cutoff frequency just above the sound masking frequency band such that each loudspeaker assembly coupled to the masking signal generator receives a filtered electrical sound masking signal. As is known, as the acoustic output signal from a loudspeaker increases in frequency and decreases in wavelength, the loudspeaker becomes more directional. By attenuating the frequencies above the sound masking frequency band, the sound masking system eliminates the highly directive high frequency output of the individual loudspeakers that might cause a listener to notice the location of an individual loudspeaker.

One method of achieving a loudspeaker with a low directivity index is to have the diameter of the effective aperture of emitter 306 less than or equal to the wavelength of the highest frequency of interest in the sound masking spectrum. Such a low directivity index is most easily achieved when the speaker output of each of the loudspeaker assemblies has an effective aperture area that is equal to the area of a circle of an diameter of between 1.25" and 3". In a preferred embodiment, the diameter of the effective aperture of the emitter 306 is 1.25". This diameter of the effective aperture of emitter 306 provides an emitter with an axial directional index at 3000 Hz that is less than 1 dB greater than an infinitesimally small sound source and an axial directional index at 6000 Hz that is less than 3 dB greater than an infinitesimally small sound source. Another method of achieving a loudspeaker with a low directivity index is to place a small reflector in front of the loudspeaker aperture to scatter the high frequency sounds to the sides of the loudspeaker and prevent the high frequency sounds from being axially projected by the loudspeaker. The small effective aperture of the emitter 306 also allows extending the low frequency response in the small airtight enclosure 308 due to the minimization of the mechanical stiffness of the cavity air spring.

Figure 3B:
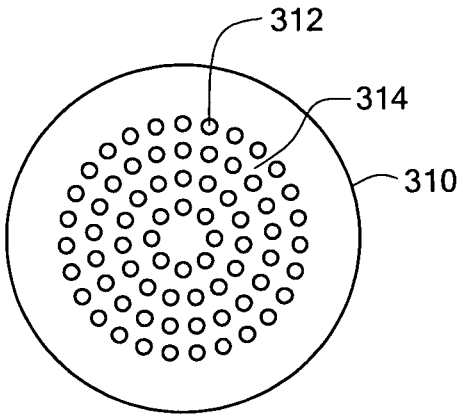
FIG. 3*b* is a plan view of a face plate for a loudspeaker assembly according to the invention.

To ensure that the sound masking signal is emitted without distortion, care should be taken in the design of any openwork grill, or face plate, used for aesthetic reasons to cover the opening of emitter, or speaker, 306. As shown in FIG. 3*b*, face plate 310 should be designed to maximize the extent of the open space of the grill work holes, slots or other open features 312 and to minimize the amount of solid material 314 around the holes. For example, for a speaker with an effective diameter of 1.25" and a face plate having a hole pattern diameter of 1.25", the open area represented by the all of the holes is approximately one-half of the face plate area.

Figure 3C:
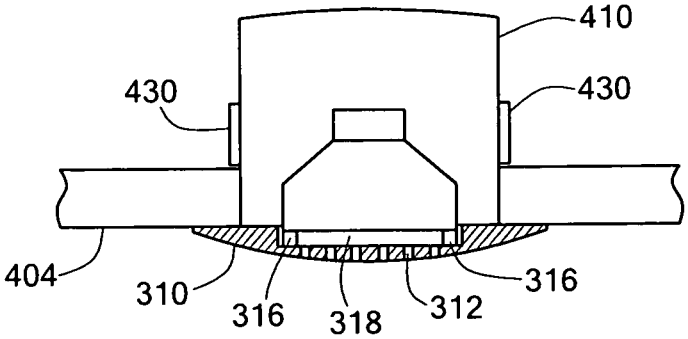
FIG. 3*c* is a section through a loudspeaker assembly, including associated face plate, according to one embodiment of the invention.
Figure 4A:
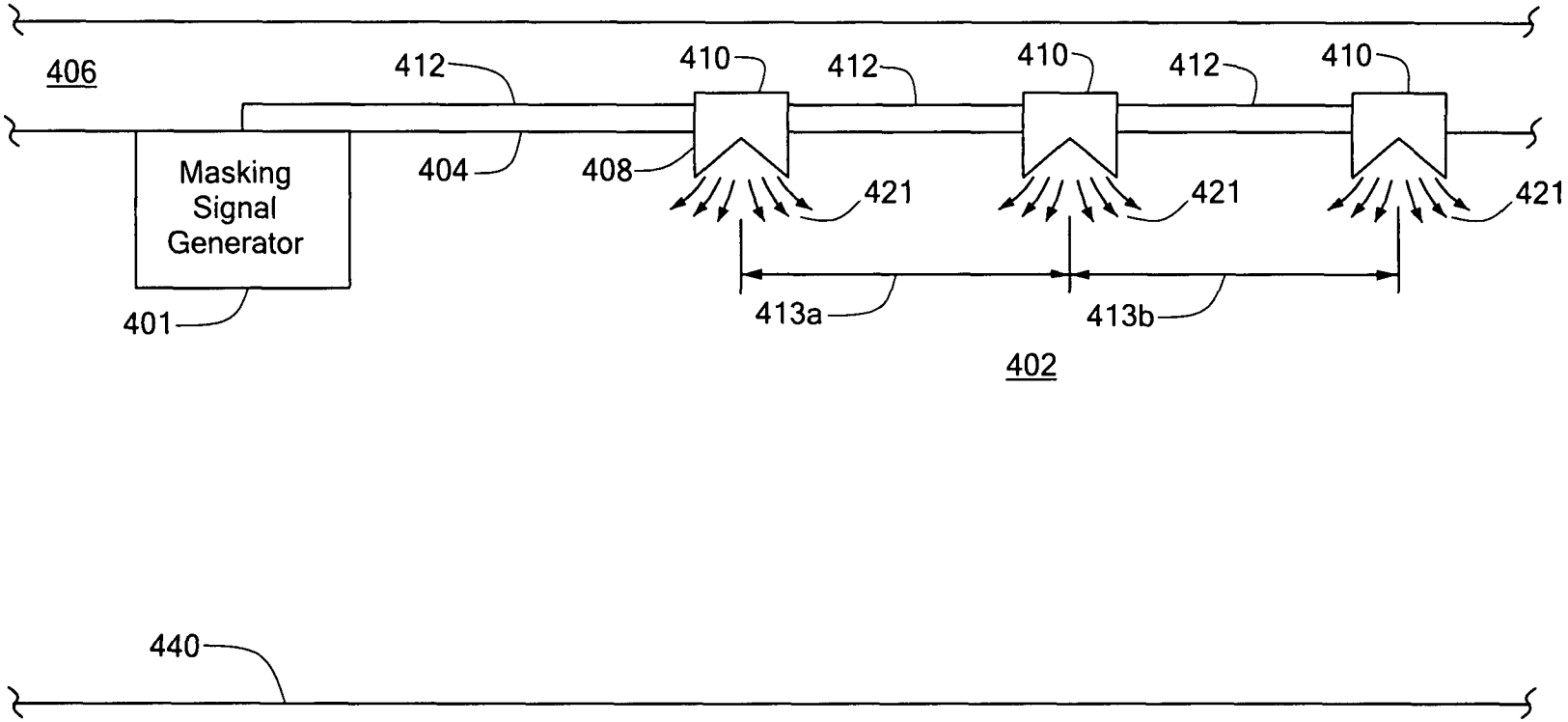
FIG. 4*a* is a schematic view of one embodiment of a sound masking system in accordance with the present invention.

FIG. 4*a* depicts one embodiment of a direct field sound masking system according to the present invention. FIG. 4*a* depicts an office area 402 that includes a ceiling 404, a plenum area 406, and a floor 440. A masking signal generator 401 provides two or more signal channels of mutually incoherent electric sound masking signals having temporally random signals with frequency characteristics within a predetermined sound masking spectrum. The masking signal generator 401 is coupled to a plurality of loudspeaker assemblies 410 with a low directivity index that are disposed within a corresponding aperture 408 in the ceiling 404 so as to provide an acoustic sound masking signal 421 in a direct audio path into one or more masking zones within the office area 402. Preferably, the lower surface of the loudspeaker assembly 410 is co-planar with the lower surface of the ceiling 404 to reduce any reflections from the lower surface of the ceiling. Referring also to FIG. 3*c*, a loudspeaker assembly 410, installed through a ceiling tile in ceiling 404, has an associated face plate 310. Any air cavity 318 that might occur between the speaker face and the face plate because of the presence of a sealing gasket 316 should be minimized by the design of the face plate to reduce the possibility of an undesirable resonance being established.

The acoustic sound masking signal 421, which can have the sound masking spectrum described above, corresponds to the electrical sound masking signal received from the masking signal generator 401 as modified by the acoustic transfer function of the loudspeaker. The loudspeaker assemblies 410 are spaced apart from one another a distance 413*a* and 413*b* such that there is sufficient overlap in the acoustic sound masking signals provided by adjacent loudspeaker assemblies 410 to produce a nearly uniform level of the acoustic sound masking signal 421 in the office area 402.

The loudspeaker assembly 410 is designed to minimize the work effort required to provide a correct installation of the soundmasking speakers and associated wiring. Each loudspeaker assembly 410 could be wired directly to the masking signal generator 401 or, more typically, the assemblies are connected in a daisy-chain fashion from one loudspeaker assembly to the next (as described in U.S. Pat. No. 6,888,945, incorporated by reference herein) via connections 412, using readily available and inexpensive wiring with at least four pairs of conductors, such as CAT-3, 5, 5A or 6 wire. To simplify assembly, the wiring pieces are terminated at both ends with quick connect/disconnect connectors, such as RJ-45 or RJ-11 connectors, corresponding to integral input and output jacks on the loudspeakers. This eliminates any need for on-the-job cable stripping.

Figure 3D:
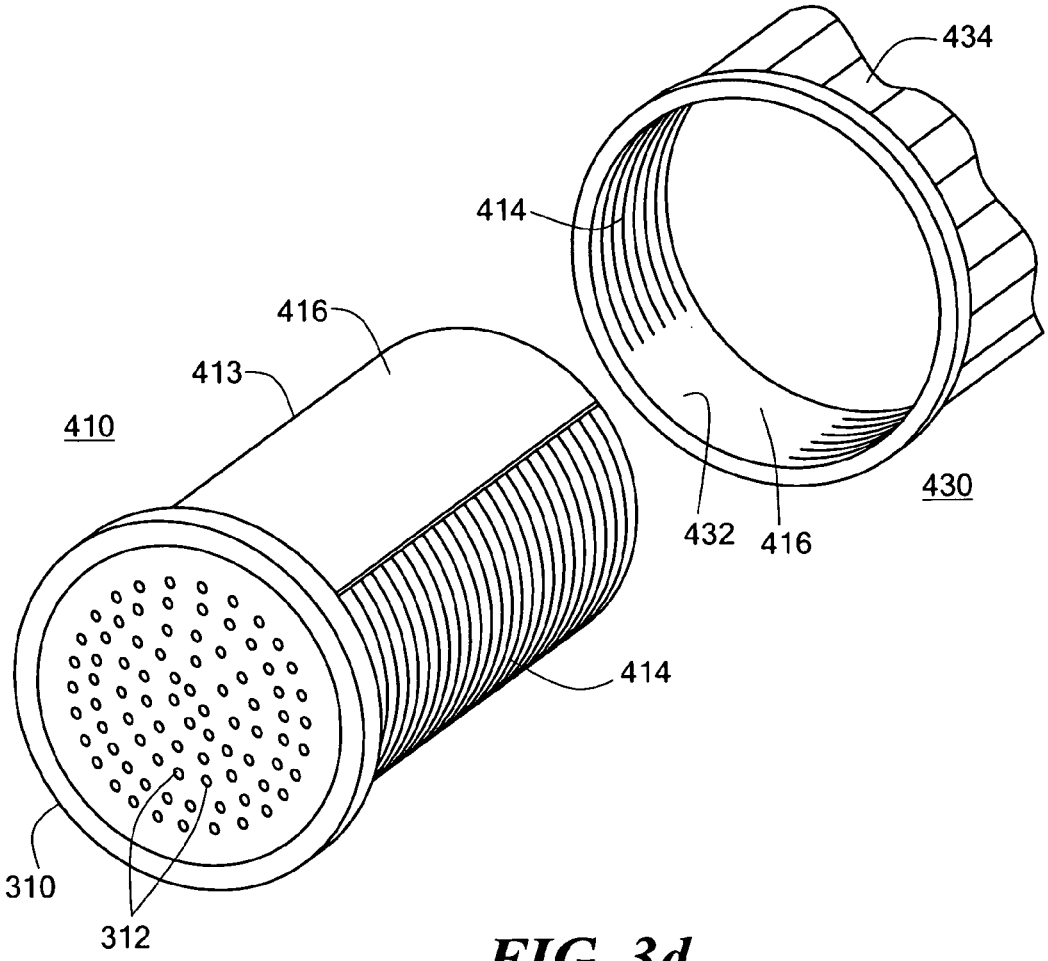
FIG. 3*d* depicts a bolt and nut threading system according to the invention for positioning and locking a nut on a bolt.
Figure 3E:
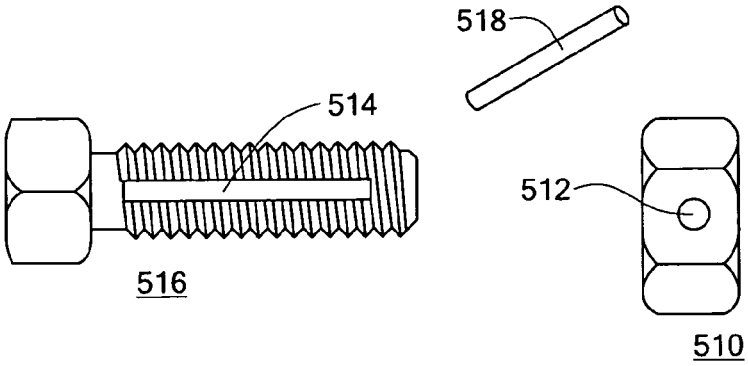

Further, the loudspeaker housing is designed to allow quick assembly through a slip-thread feature. As shown in FIG. 3*d*, loudspeaker housing 410 is threaded in segments around its outside surface 413, with threads in threaded areas 414 and no threads in smooth areas 416. In the embodiment shown, there are two threaded areas 414 (only half of which are shown), which alternate with smooth areas 416, around the outside of the loudspeaker housing. Associated with each loudspeaker housing is a clamping plate or nut 430, which is threaded on its inside surface 432 in the same pattern, with threads in threaded areas 414 and no threads in smooth areas 416. The outside surface 434 of nut 430 is knurled 432 for ease of grasping. For system installation, the loudspeaker portion of the assembly, with associated face plate, is inserted from the underside of a ceiling tile, through a hole in the tile, as shown in FIG. 3*c*. Nut 430 is then aligned with the portion of the assembly 410 emerging from the ceiling tile so that the smooth area on the inner surface of the nut corresponds to the threaded area of the outer surface of the loudspeaker end, pushed down the loudspeaker end to the back face of the ceiling tile and tightened in place with a one-quarter turn of the nut 430. Thus, system assembly is advantageously performed by a sequence of simple operations consisting of removing a ceiling tile, drilling a single small aperture through the tile, inserting the loudspeaker assembly in the opening in the tile and clamping it in place, snapping a cable wire from the last loudspeaker assembly into the current loudspeaker assembly input quick-connector jack, positioning the free end of the cable forward to the next loudspeaker assembly location and, finally, replacing the tile. The installation is carried out with the system operational to insure that each loudspeaker assembly is working properly before proceeding to installation of the next component.

In some circumstances, phase effects due to constructive and destructive interference between the acoustic sound masking signals emitted by two or more loudspeaker assemblies may occur. To substantially eliminate this problem, the masking signal generator 401 can produce two or more channels of mutually incoherent sound masking signals. The masking signal generator can be placed in a convenient location such as an equipment room, or the masking signal generator can be secured to a wall, the lower surface of the ceiling and within the office area 402, or the upper surface of the ceiling 404 and within the plenum area 406. The masking signal generator will typically include two or more power amplifiers that are sized according to the number of loudspeaker assemblies that are to be driven with the electrical sound masking signal.

Figure 4B:
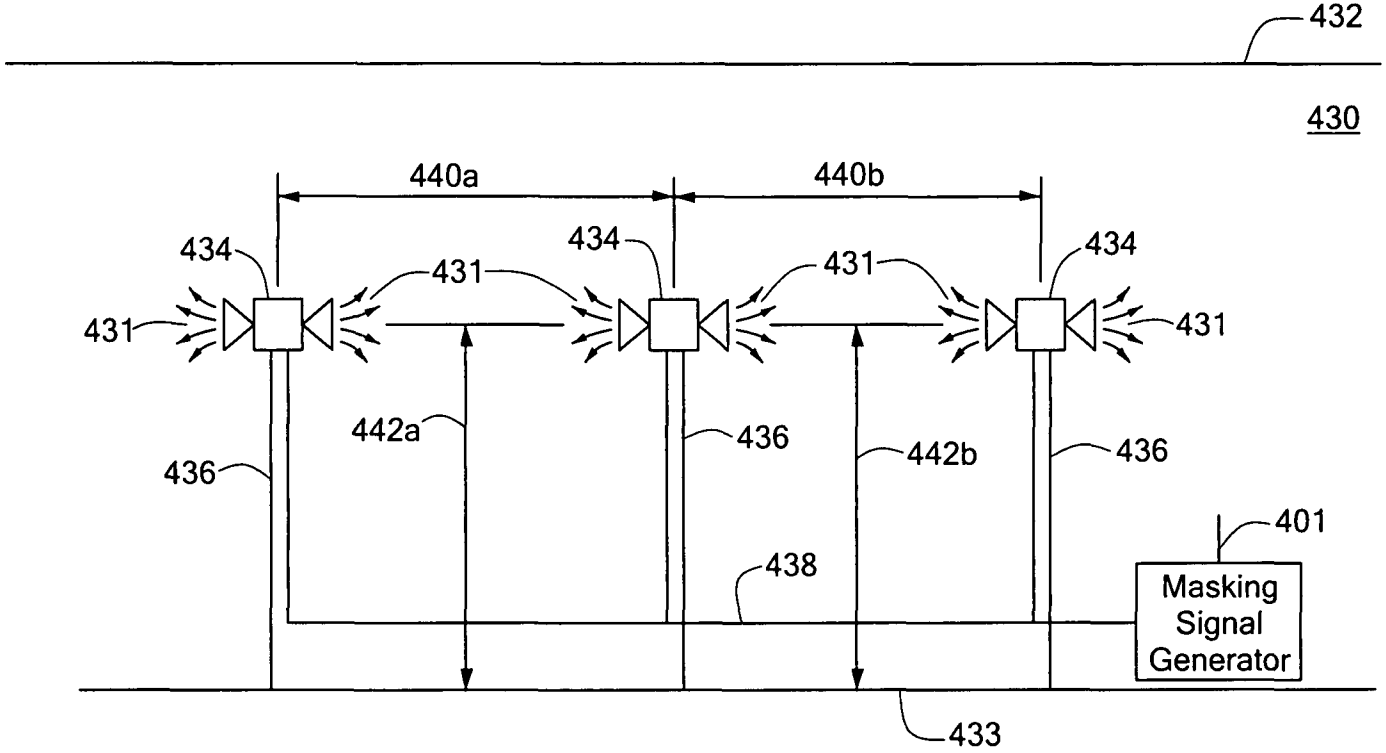
FIG. 4*b* is a schematic view of another embodiment of a sound masking system in accordance with the present invention.

Alternatively, FIG. 4*b* depicts another embodiment of a direct field sound masking system according to the present invention. FIG. 4*b* depicts an office area 430 that includes a ceiling 432 and a floor 433. A masking signal generator 401 described above with respect to FIG. 4*a* provides the two or more channels of electrical sound masking signals to a plurality of emitter assemblies 434 that are disposed within the office area 430 on supports 436. Each of the emitter assemblies 434 includes at least one loudspeaker assembly having a low directivity index so as to provide an acoustic sound masking signal 421 in a direct audio path into one or more masking zones within the office area 430. Each of the emitter assemblies 434 are supported at a height 442*a* and 442*b* sufficient to allow the acoustic sound masking signal from an emitter assembly 434 to propagate over any intervening acoustic barriers and into the associated workstation area via a direct path. As discussed above, the emitter assemblies 434 are spaced apart from one another a distance 440*a* and 440*b* such that there is sufficient overlap in the acoustic sound masking signals provided by adjacent loudspeaker assemblies 434 to produce a nearly uniform level of the acoustic sound masking signal 431 in the office area 430. Each of the emitter assemblies 434 preferably includes at least two loudspeaker assemblies and in a preferred embodiment includes three loudspeaker assemblies. If multiple loudspeaker assemblies are used within the emitter assemblies 434, the loudspeaker assemblies are configured and oriented to provide coverage over a maximum area.

The masking signal generator can be placed in a convenient location such as an equipment room, or the masking signal generator can be placed adjacent to an emitter assembly and secured to the post or support 436. The sizing of power amplifiers that may be included with the masking signal generator is the same as discussed above with respect to FIG. 4*a*. The use of two or more mutually incoherent electrical sound masking signals is the same as discussed with respect to FIG. 4*a*.

The advantages of the direct path sound masking systems described herein are primarily in the installation and setup of the sound masking system. In particular, the use of a direct path sound masking system eliminates the need for site specific frequency equalization and spectrum testing. In addition, no combustible, smoke generating, or flame spreading material is introduced into the plenum area. The advantages of the small size and weight of the loudspeaker assemblies 410 or 434 are many. The reduced high frequency beaming and reduced overall cost of the loudspeakers allows more loudspeaker assemblies to be used for a given cost. This permits a higher density of loudspeakers within the overall loudspeaker constellation. In addition, the use of more and smaller loudspeakers reduces the overall power required by each individual loudspeaker, reducing the overall power consumption and improving the overall energy efficiency.

It should be appreciated that a direct field sound masking system of the type described herein can utilize a combination of the ceiling mounted and pole mounted loudspeaker assemblies. The selection of the numbers, the locations and overall constellation of loudspeaker assemblies is a design choice and is a function of the configuration of the particular area to be masked.

Figure 5:
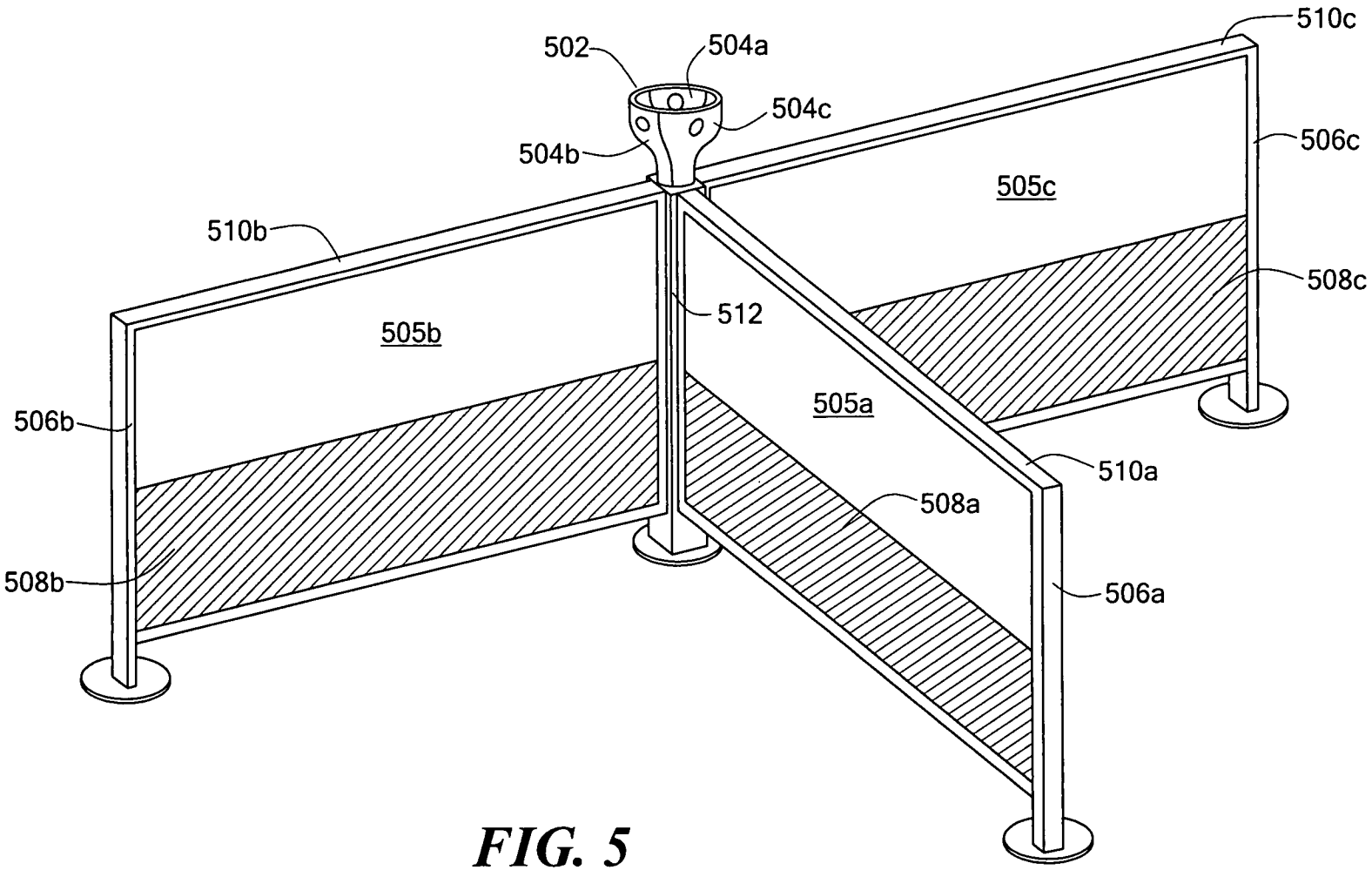
FIG. 5 depicts a plan view of one embodiment of the placement of sound masking speakers.
Figure 6:
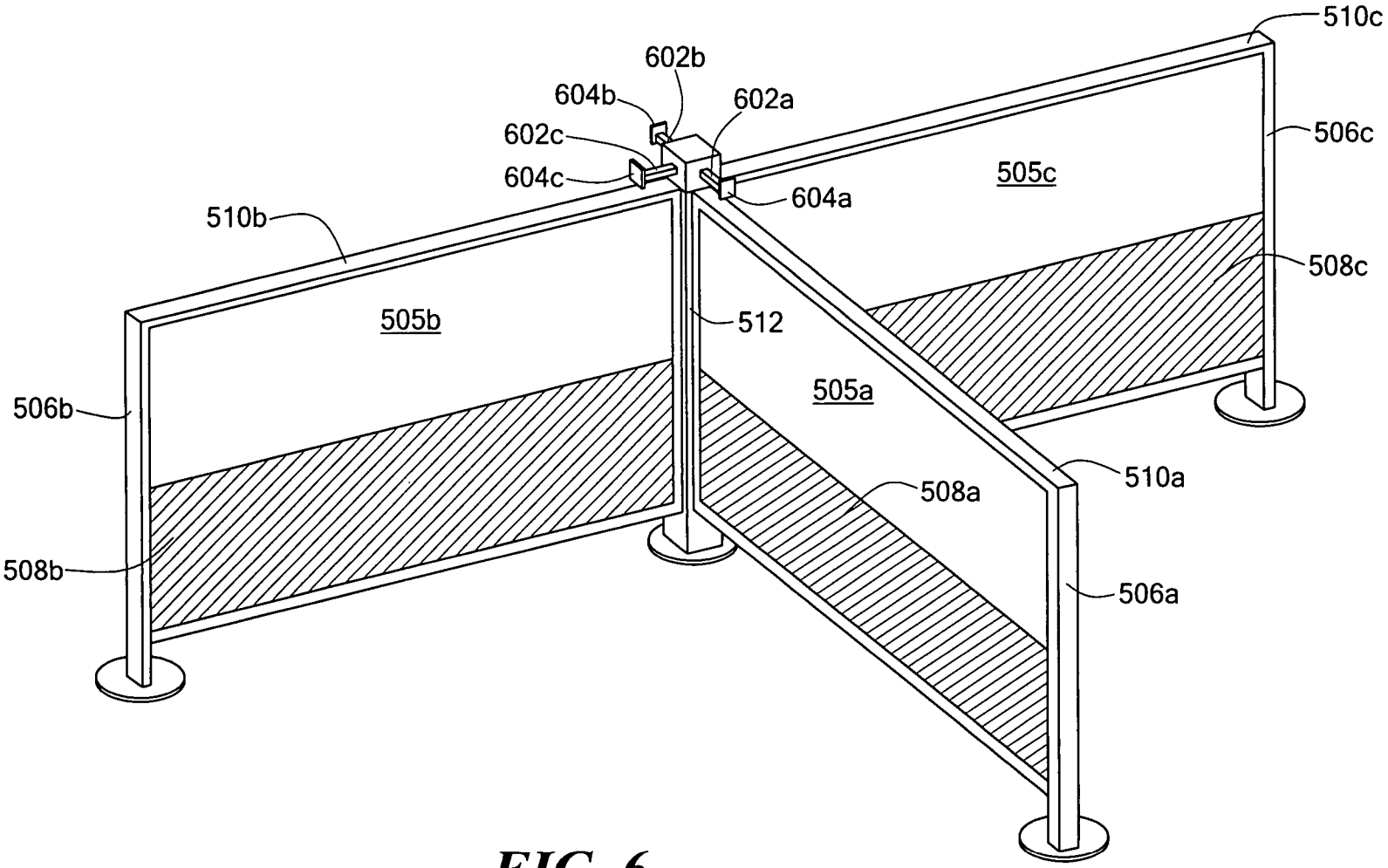
FIG. 6 depicts a plan view of another embodiment of the placement of sound masking speakers.
Figure 7:
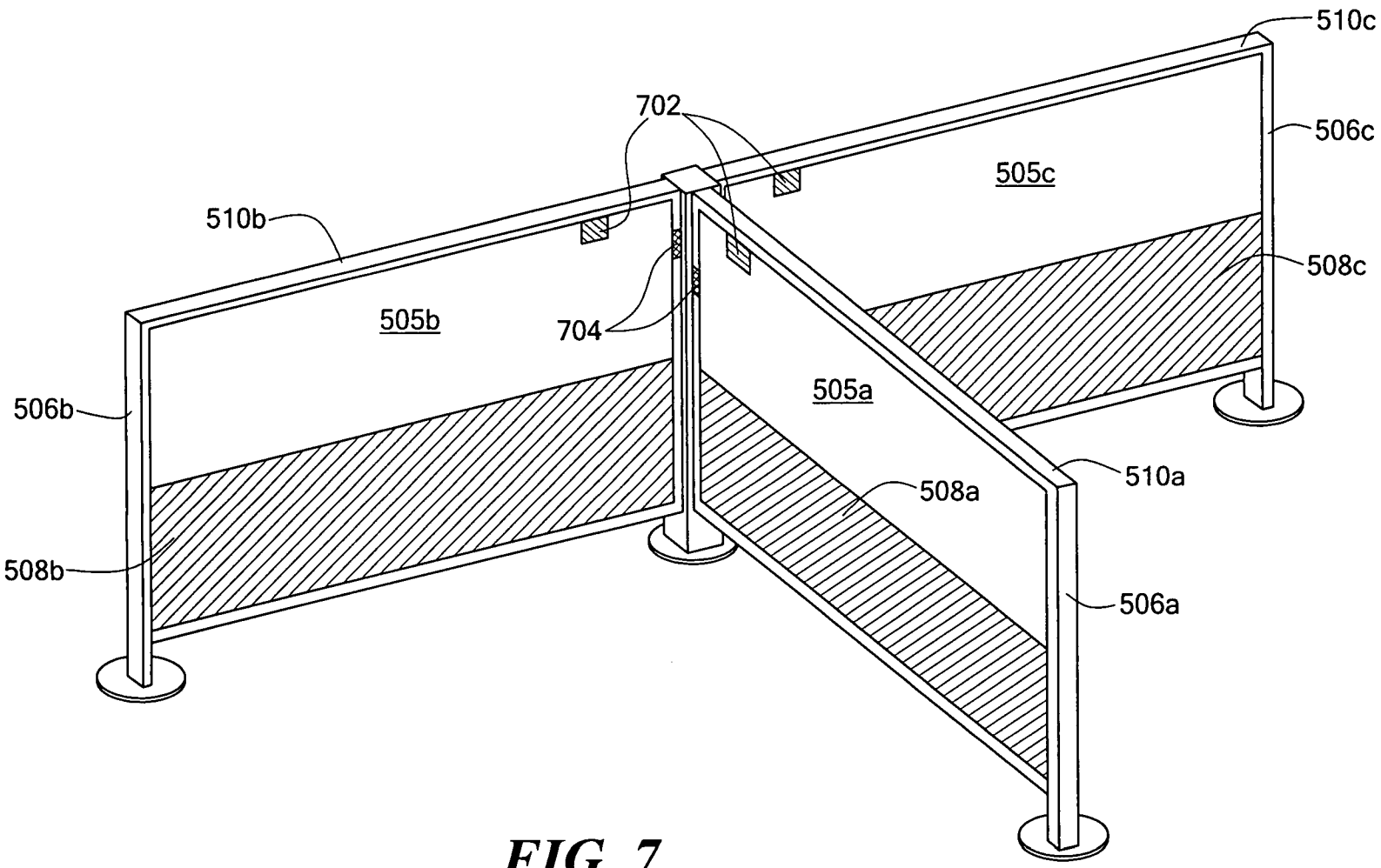
FIG. 7 depicts a plan view of another embodiment of the placement of sound masking speakers.

FIGS. 5-7 depict various configurations of placement of the emitter assemblies 434 within an open plan office utilizing the various acoustic barriers and the associated support structures. FIGS. 5-7 depict an intersection of three acoustic barriers 505*a-c* that include a first barrier support member 506*a-c*, barrier material 508*a-c*, a top support member 510*a-c*, and a center support member 512.

In the discussion of FIGS. 5-7 that follow, the top support member 512, or other support members, can be used as conduit to route the necessary cables.

In the embodiment depicted in FIG. 5, the emitter assembly includes three loudspeaker assemblies 504*a-c* that are disposed within a crown structure 502 that is disposed on top of the center support member 512. In another embodiment, the crown structure can be comprised of three "petals" and the loudspeaker assemblies 504*a-c* can be disposed within the surface of the petal such that the loudspeaker assembly is coplanar with the outer surface of the associated petal.

In the embodiment depicted in FIG. 6, the emitter assembly includes three loudspeaker assemblies 604*a-c* that are mounted on arms 602*a-c*. The arms 602*a-c* are mounted to the central support member 512 and the loudspeaker assemblies 604*a-c* extend above the upper support members 510*a-c*.

In the embodiment depicted in FIG. 7, the loudspeaker assemblies can be mounted on the upper support member 510*a-c*, and/or mounted in a channel on the center support member 512, or other vertical support member. In this case, each loudspeaker assembly is operative to provide a sound masking signal into the adjacent workstation area only so that more loudspeaker assemblies are needed.

It should be appreciated that other variations to and modifications of the above-described sound masking systems for masking sound within an open plan office may be made without departing from the inventive concepts described herein. For example, the connection between the masking signal generator and the loudspeaker assemblies does not have to be a physical connection via a conductor. Other forms of analog or digital transmission such as infrared, radio frequency, or ultrasonic signals can be used in multiplex system to provide multiple signal channels to one or more sets of loudspeaker assemblies. The receiving loudspeaker assemblies would require additional components to receive and process the transmitted signals. Accordingly, the invention should not be viewed as limited except by the scope and spirit of the appended claims.

What is claimed is:

1. A direct field sound masking system for providing a direct path sound masking signal to the ears of a listener in a predetermined area of a building, said predetermined area including a ceiling and a floor, said system comprising:

a plurality of loudspeaker assemblies, each loudspeaker assembly coupled to one or more sources of an electrical sound masking signal, wherein each of the plurality of loudspeaker assemblies has a voice coil coupled to an audio emitter operative to emit an acoustic sound masking signal corresponding to said electrical sound masking signal, wherein each said audio emitter is a cone emitter, wherein each of the plurality of loudspeaker assemblies has a low directivity index, and wherein each of the plurality of loudspeaker assemblies is constructed and oriented to provide the acoustic sound masking signal in a direct path to the ears of said listener in said predetermined area.

2. The sound masking system of claim 1, wherein the plurality of loudspeaker assemblies are interconnected via multi-conductor American Wire Gage (AWG) No. 24 size wiring pieces terminated at both ends with quick connect/disconnect connectors, said quick connect/disconnect connectors corresponding to integral input and output jacks on said loudspeaker assemblies.

3. The sound masking system of claim 2, wherein said multi-conductor wiring pieces comprise at least four pairs of conductors.

4. The sound masking system of claim 2, wherein said quick connect/disconnect connectors are TIA/EIA-IS-968-A Registered Jack 45 (RJ-45) connectors.

5. The sound masking system of claim 1, wherein, in said plurality of loudspeaker assemblies each having a low directivity index, each said audio emitter has an effective aperture area that is less than or equal to the area of a circle having a diameter of 3.0 inches.

6. The sound masking system of claim 1, wherein, in said plurality of loudspeaker assemblies each having a low directivity index, each said audio emitter has an effective aperture area that is less than or equal to the area of a circle having a diameter of 1.5 inches.

7. The sound masking system of claim 1, further comprising a remote control unit remotely coupled to said one or more signal sources and operative to adjust said signal.

8. The sound masking system of claim 1, wherein one or more of said signal sources provide two or more signal channels of electrical sound masking signals.

9. The sound masking system of claim 8, further comprising a remote control unit remotely coupled to said one or more signal sources and operative to adjust said signal.

10. The sound masking system of claim 8, wherein the plurality of loudspeaker assemblies are interconnected in a daisy-chain fashion such that the electrical sound signals are received by each loudspeaker assembly on respective input connections and transmitted to an adjacent loudspeaker assembly in said chain on respective output connections, each loudspeaker assembly including an audio emitter connected to a predetermined one of the input connections, the interconnection between each pair of adjacent audio emitter modules being operative to shift the input connections on which the respective electrical sound signals appear such that successive audio emitters emit different ones of the corresponding acoustic sound signals.

11. The sound masking system of claim 1, wherein one or more of said signal sources is a sound masking signal generator operative to provide two or more signal channels of mutually incoherent electrical sound masking signals and wherein, in at least a portion of said loudspeaker assemblies, each loudspeaker assembly is operative to receive the electrical sound masking signal from one of said signal channels and to emit an acoustic sound masking signal corresponding to said electrical sound masking signal.

12. The sound masking system of claim 11, wherein one or more of said sound masking signal generators comprises a plurality of stored sets of information.

13. The sound masking system of claim 11, further comprising a remote control unit remotely coupled to said sound masking signal generator and operative to adjust said electrical sound masking signals.

14. The sound masking system of claim 13, wherein said remote control unit is operative to signal said sound masking signal generator to adjust at least one frequency component of a selected sound masking spectrum of a generated acoustic sound masking signal corresponding to said electrical sound masking signal.

15. The sound masking system of claim 14, wherein one or more of said sound masking signal generators comprises a plurality of stored sets of information and wherein the remote control unit is operative to adjust at least one frequency component of the selected sound masking spectrum by instructing the masking signal generator to select another one of the electrical sound masking signals.

16. The sound masking system of claim 14, wherein the remote control unit is operative to adjust at least one frequency component of the selected sound masking spectrum by instructing the masking signal generator to adjust the resultant intensity of the signals within the at least one frequency component.

17. The sound masking system of claim 7, claim 9 or claim 13, wherein the remote control unit is remotely coupled to the signal source via an infrared link.

18. The sound masking system of claim 7, claim 9 or claim 13, wherein the remote control unit is remotely coupled to the signal source via a radio frequency link.

19. The sound masking system of claim 11, wherein the plurality of loudspeaker assemblies are interconnected in a daisy-chain fashion such that the electrical sound masking signals are received by each loudspeaker assembly on respective input connections and transmitted to an adjacent loudspeaker assembly in said chain on respective output connections, each loudspeaker assembly including an audio emitter connected to a predetermined one of the input connections, the interconnection between each pair of adjacent audio emitter modules being operative to shift the input connections on which the respective electrical sound masking signals appear such that successive audio emitters emit different ones of the corresponding acoustic sound masking signals.

20. The sound masking system of claim 1, wherein at least some of the plurality of loudspeaker assemblies are disposed in corresponding apertures in said ceiling and wherein said apertures are sized and configured to receive said loudspeaker assemblies.

21. The sound masking system of claim 20, wherein at least a portion of loudspeaker assemblies that are disposed in apertures in the ceiling are spaced apart a predetermined distance to provide a uniform sound level of the acoustic sound signal in at least a portion of the predetermined area.

22. The sound masking system of claim 20, wherein at least a portion of loudspeaker assemblies that are disposed in apertures in the ceiling are spaced apart a predetermined distance to provide a diffuse sound field comprised of the plurality of acoustic sound signals emitted by the plurality of loudspeaker assemblies, the loudspeaker assemblies being disposed in at least a portion of the predetermined area.

23. The sound masking system of claim 1, wherein at least some of the plurality of loudspeaker assemblies are disposed within the predetermined area a predetermined height above the floor.

24. The sound masking system of claim 23, wherein at least a portion of loudspeaker assemblies that are disposed a predetermined height above the floor are spaced apart a predetermined distance to provide a uniform sound level of the acoustic sound signal in at least a portion of the predetermined area.

25. The sound masking system of claim 23, wherein at least a portion of loudspeaker assemblies that are disposed a predetermined height above the floor are spaced apart a predetermined distance to provide a diffuse sound field comprised of the plurality of acoustic sound signals emitted by the plurality of loudspeaker assemblies, the loudspeaker assemblies being disposed in at least a portion of the predetermined area.

26. The sound masking system of claim 1, wherein said audio emitter has an effective aperture area that is equal to the area of a circle having a diameter of between 1.25 inches and 3 inches.

* * * * *